US007081715B1

(12) United States Patent
Goldstein

(10) Patent No.: US 7,081,715 B1
(45) Date of Patent: Jul. 25, 2006

(54) METHOD OF PROVIDING BREAK-IN CONDITIONING FOR A BI-LEVEL ILLUMINATION SYSTEM

(76) Inventor: Jeffrey Jay Goldstein, 169 Pace Dr. South, West Islip, NY (US) 11795

( * ) Notice: Subject to any disclaimer, the term of this patent is extended or adjusted under 35 U.S.C. 154(b) by 36 days.

(21) Appl. No.: 11/010,160

(22) Filed: Dec. 13, 2004

(51) Int. Cl.
*H05B 37/02* (2006.01)

(52) U.S. Cl. ..... 315/159; 315/360; 315/149; 315/209 R; 315/219

(58) Field of Classification Search ..... 315/159, 315/360, 209 R, 219, 362, 149, 154, 291, 315/302, DIG. 4; 364/140
See application file for complete search history.

(56) References Cited

U.S. PATENT DOCUMENTS 5,357,170 A * 10/1994 Luchaco et al. ..... 315/159
5,699,243 A * 12/1997 Eckel et al. ..... 700/17
5,753,983 A * 5/1998 Dickie et al. ..... 307/141.4
6,225,760 B1 * 5/2001 Moan ..... 315/360

* cited by examiner

*Primary Examiner*—Thuy V. Tran
*Assistant Examiner*—Chuc Tran
(74) *Attorney, Agent, or Firm*—Myron Amer, P.C.

(57) ABSTRACT

High level and low level illuminating use of lamps in an office stairwell of the nature requiring a lamp break-in period of conditioning, wherein normally the former level is used during work hours and the latter level during off-hours, in which high level illumination is extended in its use even during off-hours in order to provide a continuous 300-hour break-in period to condition the lamps for their subsequent normal use, only one installation of the lamps thereby being required.

3 Claims, 1 Drawing Sheet

METHOD OF PROVIDING BREAK-IN CONDITIONING FOR A BI-LEVEL ILLUMINATION SYSTEM

Figure 1:
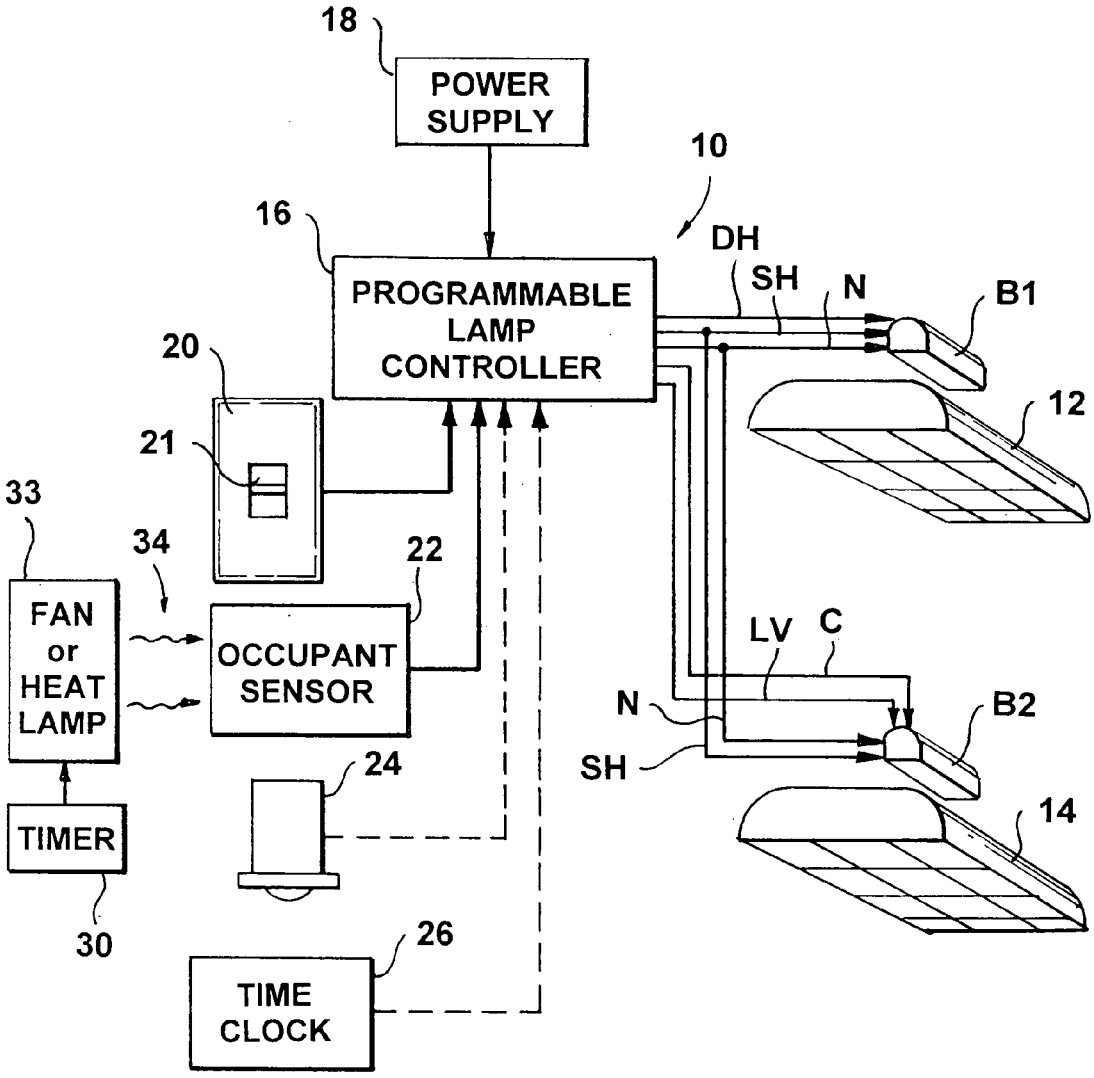

The present invention relates generally to an improvement in lighting service provided by a fluorescent lamp fixture, the improvement being more particularly in an installation in a building stairwell being serviced by the fluorescent lamp fixture.

EXAMPLE OF THE PRIOR ART

As generally known from common experience, and as is well documented in the patented literature, as exemplified by U.S. Pat. No. 6,225,760 for "FLUORESCENT LAMP DIMER SYSTEM" issued to Moan on May 1, 2001 (understood by this reference to be incorporated in this patent application pursuant to MPEP 2163.07) is the trade practice of pre-conditioning or subjecting a fluorescent lamp to a break-in operation of at least 100 hours and sometimes as much as 300 hours, during which minor manufacturing flaws are removed and/or corrected by the heat generated by the illuminating operation for the significant time duration noted. The noted break-in or lamp conditioning is typically conducted at a testing laboratory or, in any event and for no particular reason, at a site other than the site at which the lamp is used. This delays the installation at the use site for the 100 plus hours of the break-in period, and also entails a double installation cost, one at the testing site and the other at the end use site.

Broadly, it is an object of the present invention to overcome the foregoing and other shortcomings of the prior art by operating the lamp at the site of end use in a break-in mode by appropriate modification of the end use operating mode, all as will be better understood as the description proceeds.

More particularly, it is an object to focus on building stairwell light, in which the lighting service is shared as dictated by need between a low level and a high level illumination of two lamps and this sharing is intentionally dispensed with and implemented exclusively by high level illumination, the duration of exclusivity being for the break-in period. Thus, when sharing is restored, the installation in situ at the site of use has pre-conditioned lamps.

Stated somewhat differently, for lighting service provided by fluorescent lamps in significant circumstances of end use, the operating mode of the fluorescent lamp has been recognized as allowing for lamp pre-conditioning or break-in, and thus affording an opportunity to obviate the double installation expense, installation delay, and other prior art drawbacks.

The description of the invention which follows, together with the accompanying drawings should not be construed as limiting the invention to the example shown and described, because those skilled in the art to which this invention appertains will be able to devise other forms thereof within the ambit of the appended claims.

The FIGURE is a schematic illustration of a bi-level stairwell lighting system using lamps and a break-in means of conditioning said lamps in a combined cooperating relation in accordance with the present invention.

BI-LEVEL STAIRWELL LIGHTING SYSTEM

The FIGURE schematically illustrates an energy-saving lighting control system 10 adapted to control the level of lighting provided by an illustrated pair of fluorescent lamp fixtures 12 and 14, it being understood that a significantly larger number (e.g. as many as 50 two-lamp fixtures) can be controlled by the output of the system. Thus, in a stairwell which, as known by common experience is a vertical shaft or opening containing a stairway, a pair of fluorescent lamp fixtures 12 and 14 would be located at each stairway landing at each building floor or possibly at every other stairway floor landing, for providing the illumination needs intended.

The respective levels of lighting provided by lamp fixtures 12 and 14 are controlled by the respective outputs of fluorescent dimming ballasts B-1 and B-2 which operate under the control of a programmable lamp controller 16 which is adapted to receive power from an AC power source 18. The latter may vary in voltage between 100 and 277 volts, and may be either 50 or 60 hertz. The dimming ballast output of lamp controller 10 is determined by a plurality of input signals which are provided, for example, by a wall box control 20, a motion sensor 22, a photo sensor 24 and a time cock 26.

The wall box dimmer control comprises a movable actuator 21 (shown as a slider, but might be a rotary member) whose physical position determines the impedance of a potentiometer which, in turn determines the output voltage (e.g., 0–10 volts) of the control.

The operating mode of system 10 correlates the illumination needs according to what is nominally in use, i.e., the stairwell during work hours, and even less frequently in use, i.e., the stairwell during off-hours, the noteworthy conservation of energy contemplates use in the stairwell normally of the low level illumination 14 during off hours and in this site high level illumination 12 otherwise when needed, these two illumination levels 12, 14 being characterized by being alternatively operational, i.e., low level going to the high level and the high level going to the low level, but never both levels being operational simultaneously.

Also alternatively operational are the movement-sensing means 22 and a first timer-sensing means 26, also characterized by working for each other as a control for the illumination levels 12, 14, wherein the movement-sensing means 22 is effective to switch from low level illumination 14 to high level illumination 12 as a result of sensing individual activity in the stairwell and, as a control, the timer-operated sensing means 26 taking over to allow the switched-to high level illumination 12 to be in continuous operation, as needed to safely use the stairway in the stairwell, but limited to a timed duration thereof, i.e. in the contemplated cessation of any individual activity in the stairwell. Without the limit placed on the use of the high level illumination 12 by the running out of time duration set for the time clock 26, during which there is no individual activity sensed in the stairwell and thus no need for the high level illumination for safe use of the stairway, the conservation utility of the system 10 would not be achieved.

BREAK-IN CONDITIONING OF FLUORESCENT LAMPS

As known from common experience and as documented in patent literature, as exemplified by U.S. Pat. No. 6,225,760 for "FLUORESCENT LAMP DIMMER SYSTEM" issued to Moan on May 1, 2001, manufacturing flaws in a fluorescent lamp are removed and/or corrected by the heat generated by the illuminating operation thereof for a significant continuous time duration, usually not less than 100 hours and sometimes as long as 300 hours. According to trade practice, the noted break-in or lamp conditioning is conducted at a testing laboratory or, in any event, at a site other than the site at which the lamp is used which, in this case, would be in the bi-level stairwell lighting system 10 and which, thus would delay the installation of the system 10 in situ for the 100-hour plus testing duration.

Obviating this prior art drawback, use is thus made of a second timer-sensing means 30 set for a time-sensing duration of at least 100 hours and possibly 300 hours, and operatively connected to a means 32 for initiating operation of the movement-sensing means 22, a once initiated operation that would continue for the time duration of 100 hours or 300 hours, as would be the case, and it being understood that the means 33 could be an electrically powered fan or a heat lamp, the former being used if the movement-sensing means 22 was of ultrasonic type and the latter being used if the movement-sensing means 22 was of the infrared type. If a fan, the means 33 would emit an air stream 34, and if a heat lamp, the means 33 would generate heat waves, also designated 34.

As illustrated, the means 33 has an operative position effective to have its air stream/generated heat waves 34 impinge upon the movement-sensing means 22 so as to cause illumination of the lamp 12 for the break-in duration of 100 plus hours, after which the operation of means 33 would terminate and the intended bi-level system 10 will be operational. There will thus be available a system 10 which is in situ with a conditioned lamp 12.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination:

A. an illuminating end use of lamps for a stairwell of an office building during work hours that are nominally in use and less frequently in use during off-hours, and B. break-in conditioning of said lamps at said end use thereof;

said illuminating end use comprising:

(1) a low level illumination in normal off-hour use for power conservation and a high level illumination for effective use of said stairwell characterized in said illumination levels being alternatively operational for each other;

(2) a movement-sensing means and a first timer-sensing means characterized in said sensing means being sequentially operational for each other;

(3) said movement-sensing means being effective firstly to switch from said low level to said high level illumination operation in response to sensing an individual's movement on said premises; and (4) said timer-operated sensing means being effective secondly to allow said high level illumination to remain in continuous operation but only for a timed duration to correspondingly limit power consumption for said high level illumination to said timed duration;

and said break-in conditioning of said lamps comprising:

(5) a second timer-sensing means set for a time-sensing duration of at least one hundred hours;

(6) an electrically powered fan means operatively effective to emit an air stream; and (7) an operative position of said fan means effective to have said emitted air stream thereof impinge upon said movement-sensing means so as to cause high level illumination of said lamps;

whereby said high level illuminating operation of said lamps in situ for said one hundred-hour duration conditions said lamps for subsequent use.

2. In combination:

A. an illuminating end use of lamps for a stairwell of an office building during work hours that are nominally in use and less frequently in use during off-hours, and B. break-in conditioning of said lamps at said end use thereof;

said illuminating end use comprising:

(1) a low level illumination in normal off-hour use for power conservation and a high level illumination for effective use of said stairwell characterized in said illumination levels being alternatively operational for each other;

(2) a movement-sensing means and a first timer-sensing means characterized in said sensing means being sequentially operational for each other;

(3) said movement-sensing means being effective firstly to switch from said low level to said high level illumination operation in response to sensing an individual's movement on said premises; and (4) said timer-operated sensing means being effective secondly to allow said high level illumination to remain in continuous operation but only for a timed duration to correspondingly limit power consumption for said high level illumination to said timed duration;

and said break-in conditioning of said lamps comprising:

(5) a second timer-sensing means set for a time-sensing duration of at least one hundred hours;

(6) an electrically powered heat lamp operatively effective to generate heat waves; and (7) an operative position of said heat lamp effective to have said generated heat waves to impinge upon said movement-sensing means so as to cause high level illumination of said lamps;

whereby said high level illuminating operation of said lamps in situ for said one hundred-hour duration conditions said lamps for subsequent use.

3. In combination:

A. an illuminating end use of lamps for a stairwell of an office building during work hours that are nominally in use and less frequently in use during off-hours, and B. break-in conditioning of said lamps at said end use thereof;

said illuminating end use comprising:

(1) a low level illumination in normal off-hour use for power conservation and a high level illumination for effective use of said stairwell characterized in said illumination levels being alternatively operational for each other;

(2) a movement-sensing means and a first timer-sensing means characterized in said sensing means being sequentially operational for each other;

(3) said movement-sensing means being effective firstly to switch from said low level to said high level illumination operation in response to sensing an individual's movement on said premises; and (4) said timer-operated sensing means being effective secondly to allow said high level illumination to remain in continuous operation but only for a timed duration to correspondingly limit power consumption for said high level illumination to said timed duration;

and said break-in conditioning of said lamps comprising:

(5) a second timer-sensing means set for a time-sensing duration of at least one hundred hours;

(6) an electrically powered means having a transmitting operating mode; and (7) an operative position of said means effective to have said transmissions therefrom impinge upon said movement-sensing means so as to cause high level illumination of said lamps;

whereby said high level illuminating operation of said lamps in situ for said one hundred-hour duration conditions said lamps for subsequent use.

* * * * *